US010245861B1

(12) United States Patent
Lim et al.

(10) Patent No.: US 10,245,861 B1
(45) Date of Patent: Apr. 2, 2019

(54) PRINTERS, PRINTER SPINDLE ASSEMBLIES, AND METHODS FOR DETERMINING MEDIA WIDTH FOR CONTROLLING MEDIA TENSION

(71) Applicant: Datamax-O'Neil Corporation, Orlando, FL (US)

(72) Inventors: Eng Hing Lim, Singapore (SG); Yaw Horng Yap, Singapore (SG); Aravindkumar Harinarayanan, Singapore (SG)

(73) Assignee: DATAMAX-O'NEIL CORPORATION, Orlando, FL (US)

( * ) Notice: Subject to any disclaimer, the term of this patent is extended or adjusted under 35 U.S.C. 154(b) by 0 days.

(21) Appl. No.: 15/724,788

(22) Filed: Oct. 4, 2017

(51) Int. Cl.
*B41J 2/165* (2006.01)
*B41J 15/02* (2006.01)
*B41J 2/315* (2006.01)

(52) U.S. Cl.
CPC ..... *B41J 15/02* (2013.01); *B41J 2/315* (2013.01)

(58) Field of Classification Search
None
See application file for complete search history.

(56) References Cited

U.S. PATENT DOCUMENTS 5,940,106 A 8/1999 Walker
6,070,048 A 5/2000 Nonaka et al.
6,832,725 B2 12/2004 Gardiner et al.
7,128,266 B2 10/2006 Zhu
7,159,783 B2 1/2007 Walczyk et al.
7,413,127 B2 8/2008 Ehrhart et al.
7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
(Continued)

FOREIGN PATENT DOCUMENTS

WO 2013163789 A1 11/2013

*Primary Examiner* — Alejandro Valencia
(74) *Attorney, Agent, or Firm* — Additon, Higgins & Pendleton, P.A.

(57) ABSTRACT

Printer spindle assembly is provided including media spindle having first end and second end, a commutator disposed circumferentially at first end, at least two brushes in electrical contact with commutator and connected to voltage source, a plurality of electrically conductive springs serially disposed on media spindle in electrical communication with commutator, and a continuous electrically conductive path formed of electrically resistive material disposed along longitudinal axis of media spindle and configured to be in electrical contact with first spring end of one or more electrically conductive springs in the compressed state to form series circuit. Voltage source, brushes, and commutator form closed electrical circuit. Each electrically conductive spring is configured to be in uncompressed state in absence of media on media spindle and one or more of electrically conductive springs is configured to be in compressed state in presence of media on media spindle.

20 Claims, 9 Drawing Sheets

(56) References Cited

U.S. PATENT DOCUMENTS 8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz m
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.

(56) References Cited

U.S. PATENT DOCUMENTS

| | | | |
|---|---|---|---|
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Pluck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todeschini et al. |
| 9,202,458 | B2 | 12/2015 | Braho et al. |
| 9,208,366 | B2 | 12/2015 | Liu |
| 9,208,367 | B2 | 12/2015 | Wangu |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van Horn et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,443,123 | B2 | 1/2016 | Hejl |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,360,304 | B2 | 7/2016 | Chang et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein |
| 9,412,242 | B2 | 8/2016 | Van Horn et al. |
| 9,418,269 | B2 | 8/2016 | Havens et al. |
| 9,418,270 | B2 | 8/2016 | Van Volkinburg et al. |
| 9,423,318 | B2 | 8/2016 | Lui et al. |
| D766,244 | S | 9/2016 | Zhou et al. |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |
| 9,491,729 | B2 | 11/2016 | Rautiola et al. |
| 9,497,092 | B2 | 11/2016 | Gomez et al. |
| 9,507,974 | B1 | 11/2016 | Todeschini |
| 9,519,814 | B2 | 12/2016 | Cudzilo |
| 9,521,331 | B2 | 12/2016 | Bessettes et al. |
| 9,530,038 | B2 | 12/2016 | Xian et al. |
| D777,166 | S | 1/2017 | Bidwell et al. |
| 9,558,386 | B2 | 1/2017 | Yeakley |
| 9,572,901 | B2 | 2/2017 | Todeschini |
| 9,606,581 | B1 | 3/2017 | Howe et al. |
| D783,601 | S | 4/2017 | Schulte et al. |
| D785,617 | S | 5/2017 | Bidwell et al. |
| D785,636 | S | 5/2017 | Oberpriller et al. |

(56) References Cited

U.S. PATENT DOCUMENTS 9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
9,931,867 B1 * 4/2018 Yap ..... B41J 15/02
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0170848 A1 7/2013 Hirota
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0100813 A1 1/2014 Showering
2014/0034734 A1 2/2014 Sauerwein
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.
2015/0210199 A1 7/2015 Payne
2015/0220753 A1 8/2015 Zhu et al.
2015/0254485 A1 9/2015 Feng et al.
2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin

(56) References Cited

U.S. PATENT DOCUMENTS

2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Geramine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van Horn et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress
2017/0092908 A1 3/2017 Chaney
2017/0094238 A1 3/2017 Germaine et al.
2017/0098947 A1 4/2017 Wolski
2017/0100949 A1 4/2017 Celinder et al.
2017/0108838 A1 4/2017 Todeschini et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 d'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delano et al.
2017/0193432 A1 7/2017 Bernhardt
2017/0193461 A1 7/2017 Jonas et al.
2017/0193727 A1 7/2017 Van Horn et al.
2017/0200108 A1 7/2017 Au et al.
2017/0200275 A1 7/2017 McCloskey et al.

* cited by examiner

PRINTERS, PRINTER SPINDLE ASSEMBLIES, AND METHODS FOR DETERMINING MEDIA WIDTH FOR CONTROLLING MEDIA TENSION

FIELD OF THE INVENTION

The present invention relates to printers and, more particularly, relates to printer spindle assemblies and methods for determining media width for controlling media tension.

BACKGROUND

Generally speaking, printers employ media on printer spindle assemblies. As used herein, "media" is any consumable product used in the printer (e.g., labels, receipts, ink ribbon, etc.). The term "media" includes "print media" on which the printer prints as well as the ink ribbon that may supply ink. Media of different widths have different torque requirements. Incorrect torque (i.e., media tension) may result in poor print quality, media wrinkles, print registration problems, black bending on printouts, and in some case, media rupture (collectively "printing problems"). Thus, it is important for the media tension to be set appropriate to the media width.

While systems exist to automatically sense the size of print media loaded into a printer by having an electrical feedback connected to the media size adjustment mechanism, such systems do not tell the printer or user anything about the proper torque values (i.e., media tension) to be used for any given printing job and for media other than print media.

Therefore, a need exists for printers, and printer spindle assemblies thereof and methods for automatically determining media width for controlling media tension.

SUMMARY

Accordingly, in one aspect, the present invention embraces a printer spindle assembly comprising a media spindle having a first end and a second end, a commutator disposed circumferentially at the first end of the media spindle, at least two brushes in electrical contact with the commutator and connected to a voltage source, a plurality of electrically conductive springs serially disposed on the media spindle in electrical communication with the commutator, and a continuous electrically conductive path formed of electrically resistive material disposed along a longitudinal axis of the media spindle and configured to be in electrical contact with a first end of the one or more electrically conductive springs in the compressed state to form a series circuit. The voltage source, the at least two brushes, and the commutator form a closed electrical circuit. Each electrically conductive spring is configured to be in an uncompressed state in the absence of media on the media spindle and one or more of the electrically conductive springs is configured to be in a compressed state in the presence of the media on the media spindle.

In another aspect, the present invention embraces a printer comprising a spindle assembly and a processor. The spindle assembly comprises a media spindle having a first end and a second end, a commutator disposed circumferentially at the first end of the media spindle, at least two brushes in electrical contact with the commutator and connected to a voltage source, a plurality of electrically conductive springs serially disposed on the media spindle in electrical communication with the commutator, and a continuous electrically conductive path formed of electrically resistive material disposed along a longitudinal axis of the media spindle and configured to be in electrical contact with a first end of the one or more electrically conductive springs in the compressed state to form a series circuit. The voltage source, the at least two brushes, and the commutator form a closed electrical circuit. Each electrically conductive spring is configured to be in an uncompressed state in the absence of media on the media spindle and one or more of the conductive springs is configured to be in a compressed state in the presence of the media on the media spindle. The processor is configured to determine a width of the media loaded on the media spindle based on the resistance of the series circuit and is configured to adjust torsion on the media based upon the determined width of the media.

In another aspect, the present invention embraces a method comprising loading media on a media spindle of a printer spindle assembly. The media spindle has a first end and a second end and the printer spindle assembly comprises a commutator disposed circumferentially at the first end of the media spindle, at least two brushes in electrical contact with the commutator and connected to a voltage source, a plurality of electrically conductive springs serially disposed on the media spindle in electrical communication with the commutator, and a continuous electrically conductive path formed of electrically resistive material disposed along a longitudinal axis of the media spindle and configured to be in electrical contact with a first end of the one or more electrically conductive springs in the compressed state to form a series circuit. The voltage source, the at least two brushes, and the commutator form a closed electrical circuit. Each electrically conductive spring is configured to be in an uncompressed state in the absence of the media on the media spindle and one or more of the electrically conductive springs is configured to be in a compressed state in the presence of the media on the media spindle. At least two brushes are connected to a voltage source. An electrical resistance of the series circuit is determined. A width of the media loaded on the media spindle is determined from the electrical resistance.

The foregoing illustrative summary, as well as other exemplary objectives and/or advantages of the invention, and the manner in which the same are accomplished, are further explained within the following detailed description and its accompanying drawings.

DETAILED DESCRIPTION

The present invention embraces printers, and printer spindle assemblies thereof and methods for automatically determining media width for controlling media tension. Various embodiments provide an automatic system that can sense the width of media disposed on a printer spindle assembly and feedback this information to an onboard processor that can implement torque requirements to achieve correct media tension.

Figure 1:
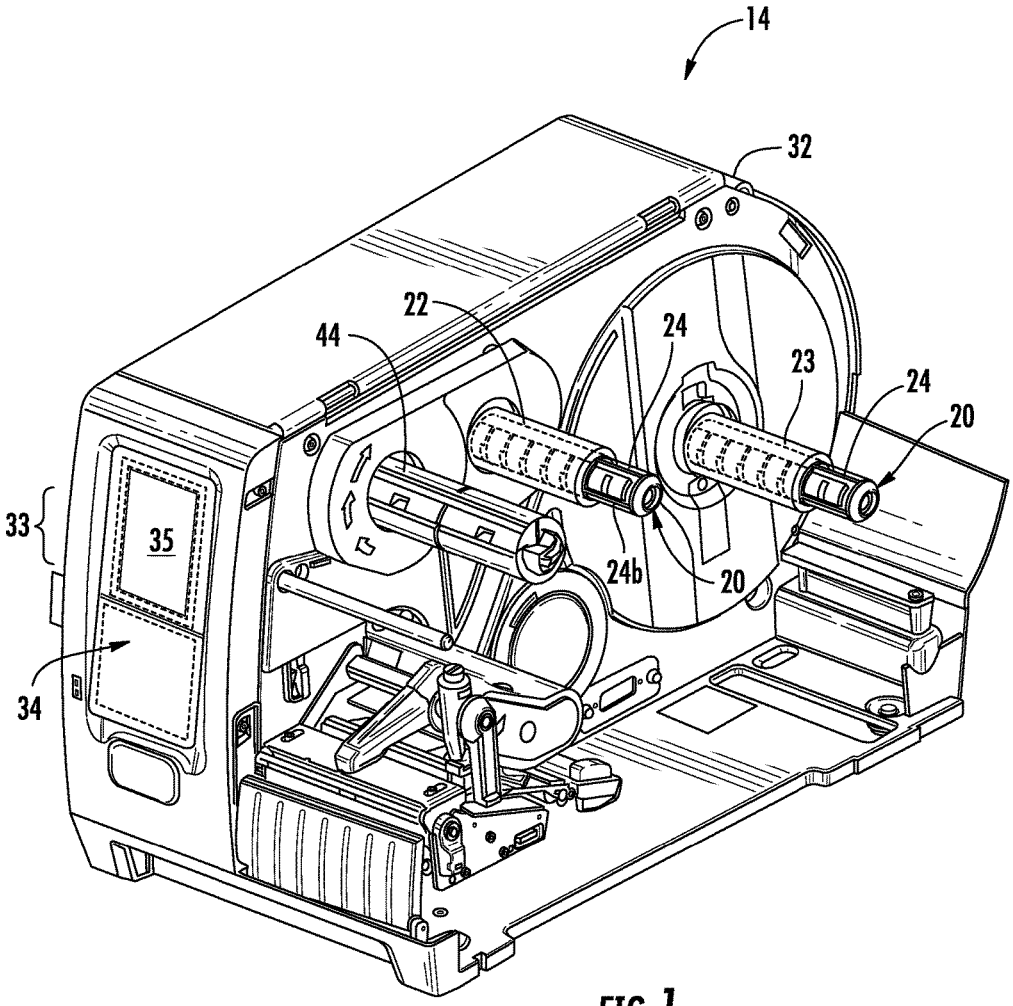
FIG. 1 graphically illustrates a portion of an exemplary printer comprising a printer spindle assembly (two exemplary printer spindle assemblies) in accordance with various embodiments of the present invention, a cover of the printer removed (i.e., an open printer) to illustrate an interior of the printer including a portion of the printer spindle assembly, according to various embodiments of the present invention.

Various embodiments of the present invention will be described in relation to a thermal transfer printer such as depicted in FIG. 1. However, the present invention may be equally applicable to other types and styles of printers (e.g., a thermal direct printer, a laser toner printer, an ink drop printer, etc.). As used herein, the term "printer" refers to a device that prints text, barcodes and other information-bearing symbols, illustrations, etc. onto non-continuous and continuous print media as hereinafter described (e.g., labels, receipts, paper, etc.). Non-continuous print media may comprise a liner portion underlying a plurality of individual print medium (a print medium portion) (e.g., a label) to define a liner only portion between each of the individual print medium. The individual print medium may be separated on the liner by gaps, holes, notches, black marks, etc. As used herein, "media" is any consumable product used in the printer (e.g., labels, receipts, ribbon, etc.). The term "media" includes "print media" on which the printer prints as well as the ribbon that may supply ink that transfers onto the print media.

Referring now specifically to FIG. 1, according to various embodiments of the present invention, an exemplary (thermal transfer) printer 14 capable of printing on print media is partially shown. The depicted printer 14 has a body 32 for enclosing an interior thereof. A moveable cover that forms a portion of the body is removed in FIG. 1 for purposes of illustration. The moveable cover permits access to, for example, the interior of the body 32 and the components contained therein.

In the case of a thermal transfer printer such as depicted in FIG. 1, there may be at least one printer spindle assembly 20 contained within the body 32, in accordance with various embodiments of the present invention. FIG. 1 depicts printer spindle assembly 20 configured to hold a ribbon supply roll 22 and another printer spindle assembly 20 configured to hold a print media supply roll 23 within the body of the printer.

The ribbon supply roll and the print media supply roll comprise exemplary "media rolls". As hereinafter described, a media roll is configured to be disposed on a media spindle 24 of the printer spindle assembly 20. For example, the ribbon supply roll comprising ribbon (exemplary media) wound on a media supply spool is configured to be disposed on a media spindle comprising a ribbon supply spindle. The print media supply roll comprising print media wound on a print media supply spool is configured to be disposed on a media spindle comprising a print media supply spindle. As used herein, the media width is equivalent to the media roll width. The media spindle comprises a hollow elongated substantially cylindrical member comprised of a nonconductive material according to various embodiments of the present invention. A ribbon rewind spindle 44 on which unwound ribbon is wound up may also be contained within the body 32. Each of the media spindles and the media rolls disposed thereon are configured to rotate.

The printer 14 further comprises a processor 33. As known in the art, the central processing unit (CPU) (i.e., the processor 33) is the electronic circuitry within a computer that carries out the instructions of a computer program by performing the basic arithmetic, logical, control and input/output (I/O) operations specified by the instructions as hereinafter described. According to various embodiments of the present invention as hereinafter described, the processor is configured to determine the width of the media loaded on the media spindle through feedback from resistance circuitry coupled to the processor. Once the media width is known to the processor, the processor causes an adjustment in media tension in accordance with the media width. The processor is further configured to implement torque requirements of the printer. By adjusting the torque requirements, the media tension is changed. The processor may be configured to send information on the width of the media loaded on the media spindle to a display 35 on the printer.

The printer further comprises other illustrated and non-illustrated components as known in the art. For example, the printer may further comprise one or more motors (not shown) for rotating the media spindle(s) and the media rolls disposed thereon, and a user interface 34 for communication between a user and the printer 14. The user interface 34 may include, but is not limited to, the printer display 35 for displaying information, including information on the width of the media loaded on the media spindle.

Returning now to FIG. 2, according to various embodiments of the present invention, the printer spindle assembly 20 comprises the media spindle 24 having a first end 24*a* and a second end 24*b*, a commutator 26 (not shown in FIG. 1) disposed circumferentially at the first end 24*a* of the media spindle, at least two (carbon) brushes 28 (not shown in FIG. 1) in electrical contact with the commutator 26 and connected to a voltage source, a plurality of electrically conductive springs (e.g., 30*a*-30*h*) serially disposed on the media spindle 24 in electrical communication with the commutator, and a continuous electrically conductive path 40 formed of electrically resistive material disposed along a longitudinal axis of the media spindle and configured to be in electrical contact with a first spring end portion 34-1 of one or more of the electrically conductive springs in the compressed state to form a series circuit. The media spindle 24, the plurality of electrically conductive springs (e.g., 30*a*-30*h* in the depicted embodiment), and the continuous electrically conductive path 40 comprising the electrically resistive material comprise a rotational potentiometer. The width of the spring can be selected to accommodate the media width.

The electrically conductive spring 30 are electrically linked to the commutator 26. The carbon brushes 28 are disposed generally on either side of the commutator 26. The voltage source, the carbon brushes, and the commutator form a closed electrical circuit. The closed electrical circuit connects the electrical circuits in series to a main electrical control unit housing the processor 33 (FIG. 1) of the printer. A meter comprising an analog to digital converter (ADC) is coupled to the processor 33. The ADC provides an isolated measurement that converts an analog voltage or current to a digital number proportional to the magnitude of the voltage or current. The processor is configured by a software program to implement torque requirements to achieve correct media tension as hereinafter described.

Figure 2:
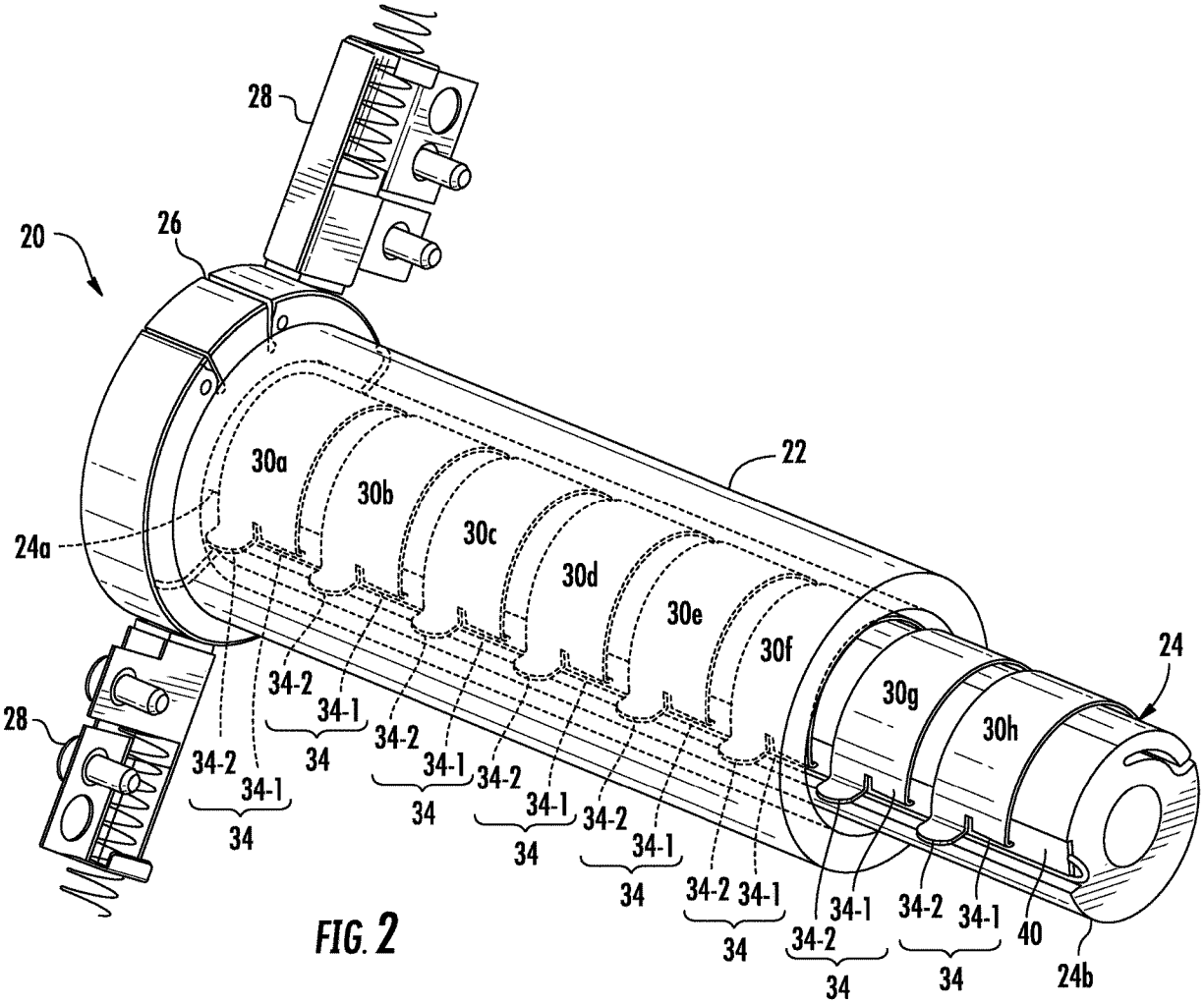
FIG. 2 graphically depicts one of the printer spindle assemblies of FIG. 1, according to various embodiments of the present invention.
Figure 3:
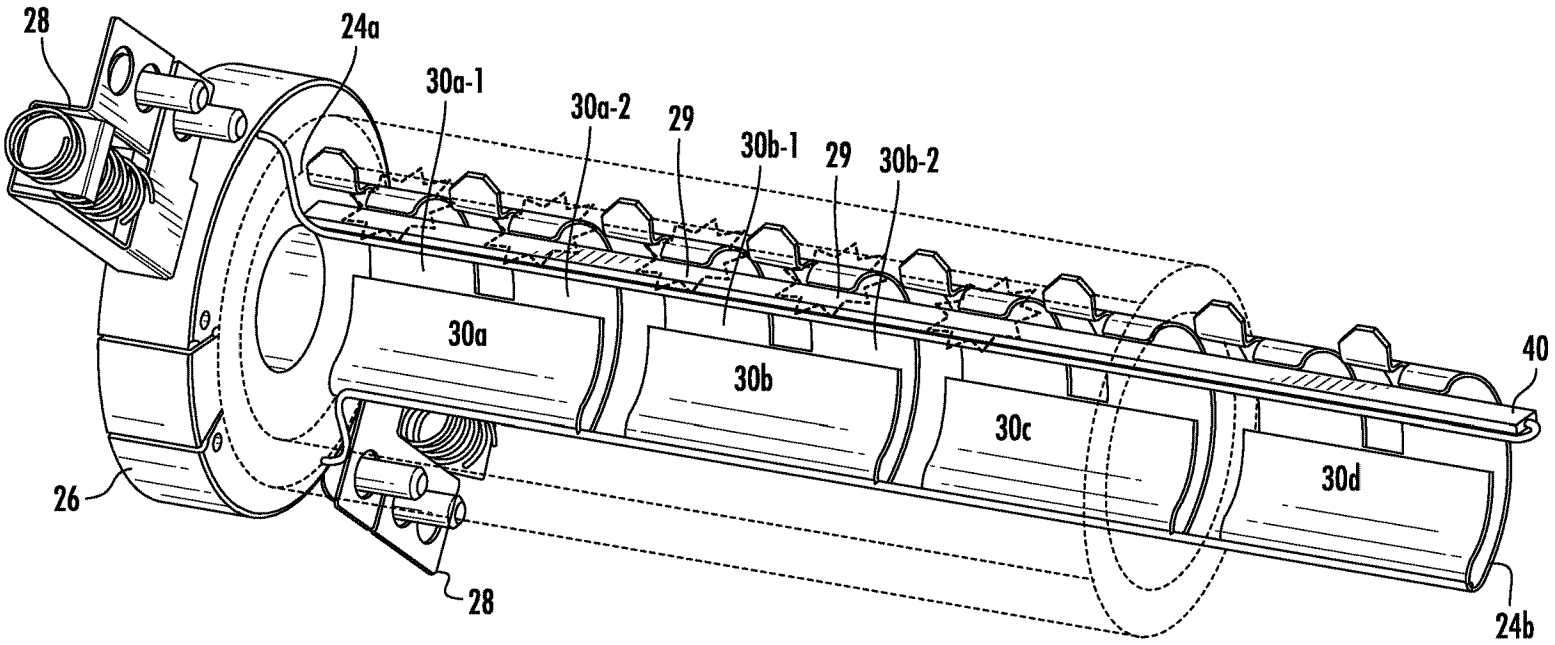
FIG. 3 graphically depicts another view of the printer spindle assembly of FIG. 2, according to various embodiments of the present invention.
Figure 6:
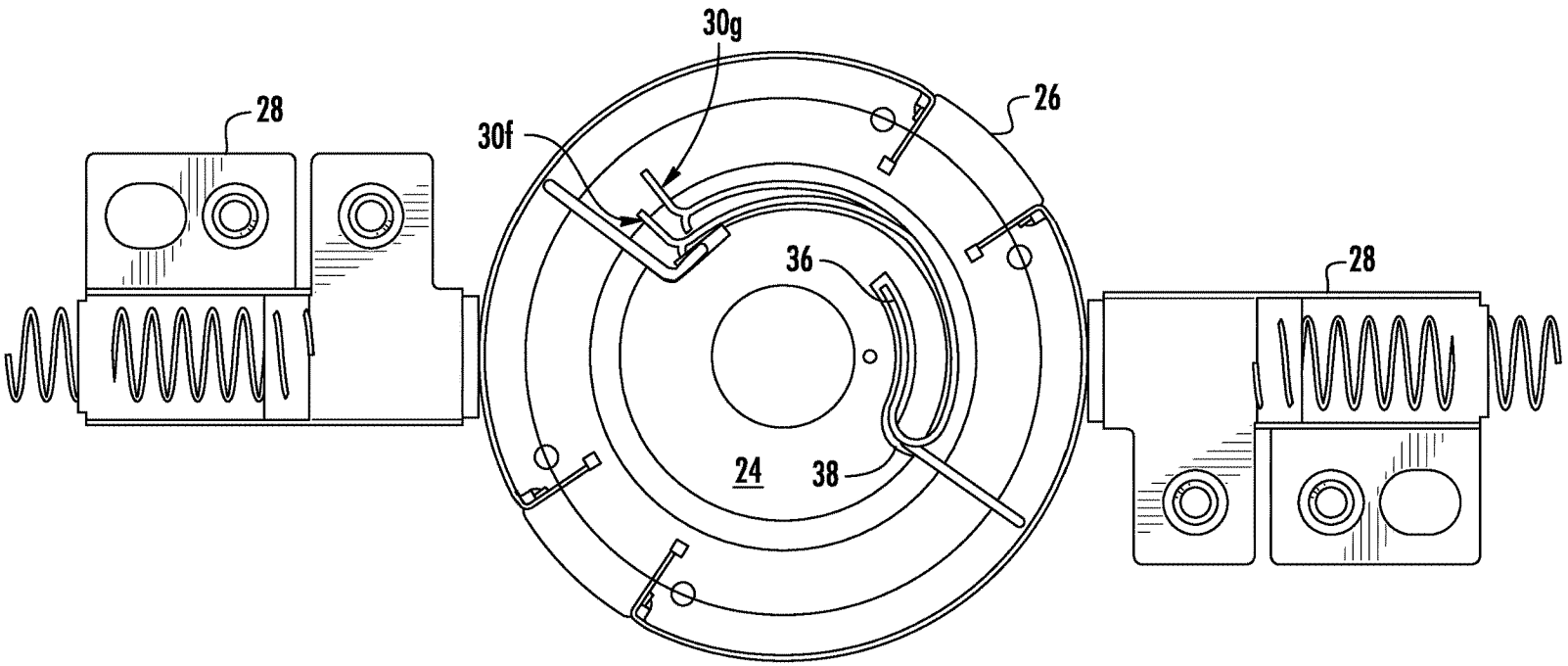
FIG. 6 is an end view of the printer spindle assembly of FIG. 2, illustrating a compressed electrically conductive spring and an uncompressed electrically conductive spring, according to various embodiments of the present invention.
Figure 7B:
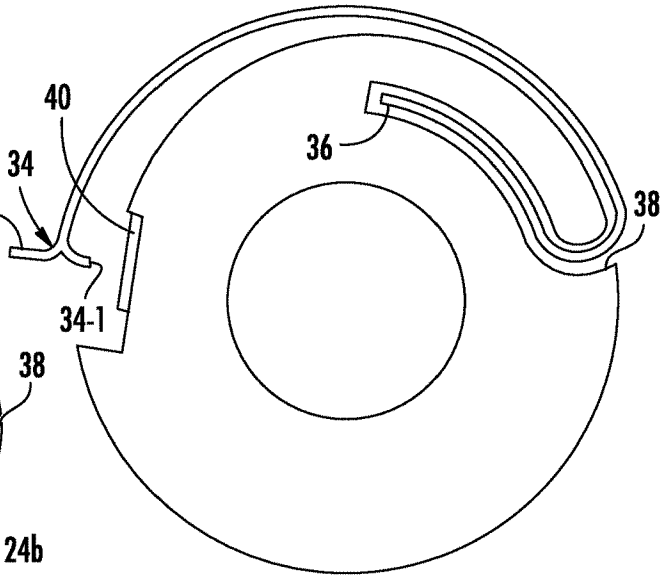
FIG. 7B depicts a second spring end of one of the uncompressed electrically conductive springs received and retained in a groove within the media spindle of the printer spindle assembly of FIG. 2, according to various embodiments of the present invention.
Figure 7A:
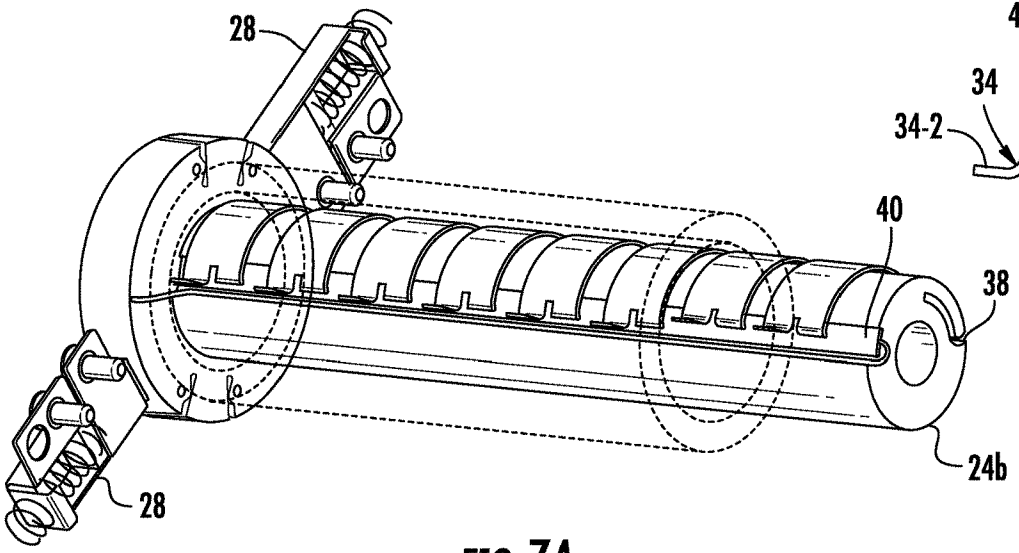
FIG. 7A graphically depicts the compressed electrically conductive springs contacting the resistive material of the printer spindle assembly, according to various embodiments of the present invention.

Still referring to FIG. 2 and now to FIGS. 3, 6, and 7B, the plurality of electrically conductive springs (30*a*-30*h* in FIG. 2) disposed on the media spindle 24 are generally C-shaped. Suitable exemplary electrically conductive springs include a leaf spring/coil spring. Each electrically conductive spring 30 comprises a pair of conjoined electrically conductive spring portions having a space therebetween to impart compressibility to each electrically conductive spring. Each electrically conductive spring has two spring ends, the first spring end 34 and a second spring end 36. The first spring end 34 gets compressed. The first spring end 34 has a first portion 34-1 facing a first direction that is used to contact the resistive material and a second portion 34-2 facing a second opposing direction that provides a surface for the media roll to contact and compress the first spring end 34. As noted previously, the first spring end 34 is configured to be compressed (deflected) when a media roll (e.g., ribbon supply roll 22) is disposed on the media spindle 24. The second spring end 36 of each electrically conductive spring is configured to be received and retained in a groove 38 (see FIG. 7B) in the media spindle. Each electrically conductive spring is metallic.

In the depicted embodiment of FIG. 2, the printer spindle assembly has eight electrically conductive springs. In the depicted embodiment of FIG. 3, the printer spindle assembly has four electrically conductive springs; however other numbers of electrically conductive springs are possible. The first electrically conductive spring disposed near the first end of the media spindle is contiguous to the commutator. The subsequent electrically conductive springs are spaced apart in serial arrangement on the media spindle in the direction of the media spindle second end. The electrically conductive springs remain in an uncompressed state when no media roll is loaded on the media spindle of the printer spindle assembly.

When a media roll is disposed on the media spindle of the printer spindle assembly, the media roll compresses one or more of the electrically conductive springs. The media roll will contact the second portion 34-2 and then the first portion 34-1 of the electrically conductive springs will touch the conductive path 40 as noted previously. Therefore, each electrically conductive spring is configured to be in an uncompressed state in the absence of media on the media spindle and one or more of the electrically conductive springs is configured to be in a compressed state in the presence of the media on the media spindle. In FIG. 2, electrically conductive springs 30*a*-30*f* are in a compressed state and electrically conductive springs 30*g*-30*h* are in an uncompressed state. In FIG. 3, electrically conductive springs 30*a*-30*c* are in a compressed state and electrically conductive spring 30*d* is in an uncompressed state. In FIG. 6, electrically conductive spring 30*f* is in the compressed state and electrically conductive spring 30*g* is in the uncompressed state.

The electrically conductive springs have a length such that when one or more of the electrically conductive springs are compressed, the first spring end of the compressed electrically conductive spring(s) will make electrical contact with the continuous electrically conductive path 40, resulting in current 29 flow (e.g., FIGS. 3, 5A, 5B, and 7A), thereby completing an electrical circuit in series with the closed electrical circuit of the voltage source, the carbon brushes, and the commutator. The continuous electrically conductive path 40 may be a strip of electrically resistive material such as carbon or may have another form that is disposed along a longitudinal axis of the media spindle. Each electrically conductive spring in electrical contact with the continuous electrically conductive path 40 decreases an amount of the electrically resistive material in the series circuit. The amount of the continuous electrically conductive path in the series circuit and therefore resistance in the series circuit increases with a decrease in a width of the media.

In FIG. 2, the media roll covers and engages the commutator and compresses electrically conductive springs 30*a* through 30*f*. Thus six additional electrical circuits in series are added to the closed electrical circuit consisting of the voltage source, the carbon brushes, and the commutator. The electrically conductive springs 30*g* and 30*h* remain uncompressed in FIG. 2.

In FIG. 3, the media roll covers and engages the commutator and compresses electrically conductive springs 30*a* through 30*c*. Electrically conductive spring 30*d* remains uncompressed in FIG. 3. Thus, three additional electrical circuits in series are added to the closed electrical circuit consisting of the voltage source, the carbon brushes, and the commutator. The path of electrical current 29 is shown passing through the electrical circuits connected in series in FIG. 3.

Figure 4B:
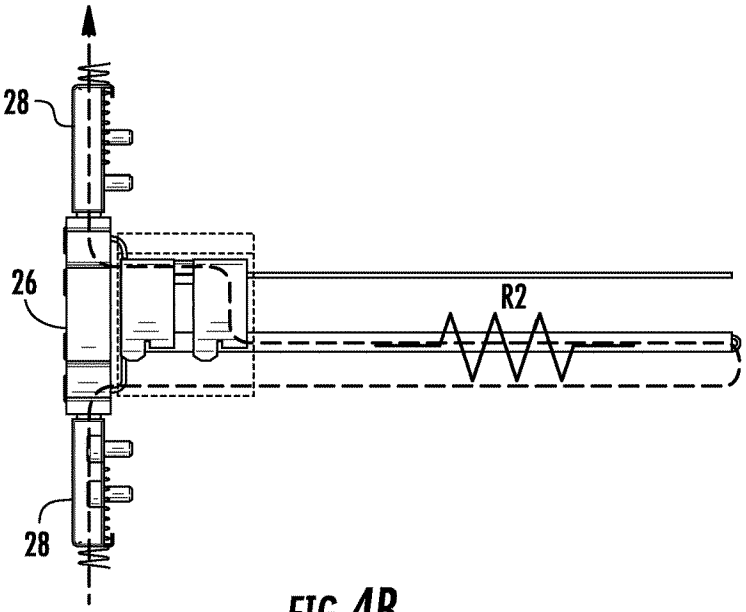
FIGS. 4A and 4B graphically compare the measured resistance between three-inch wide media (ribbon in the depicted embodiment) (FIG. 4A) versus the measured resistance of one-inch wide media (FIG. 4B), the three-inch wide media resulting in a lower resistance series circuit relative to the one-inch wide media, according to various embodiments of the present invention.
Figure 4A:
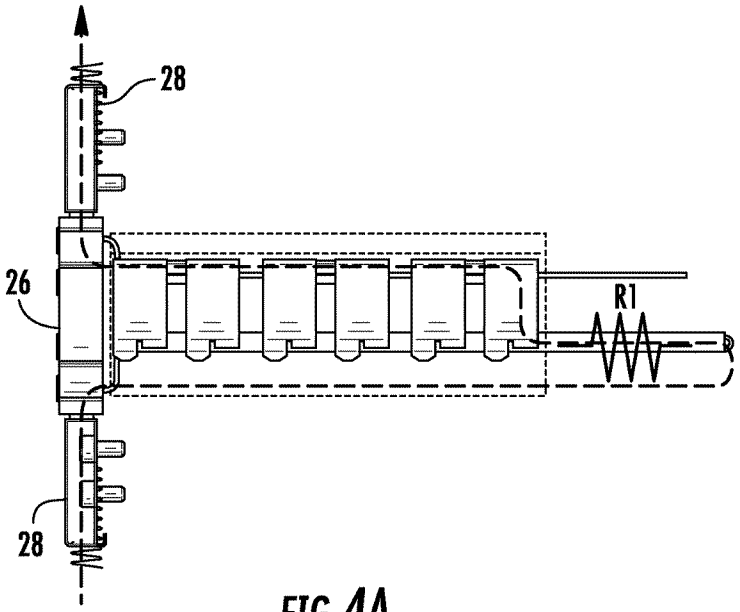
Figure 5B:
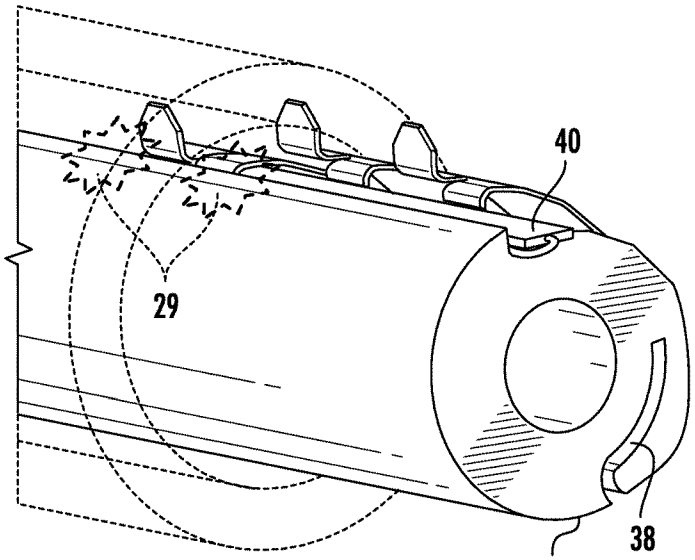
FIG. 5B graphically depicts the compressed electrically conductive springs contacting resistive material of the printer spindle assembly resulting in current flow, according to various embodiments of the present invention.
Figure 5A:
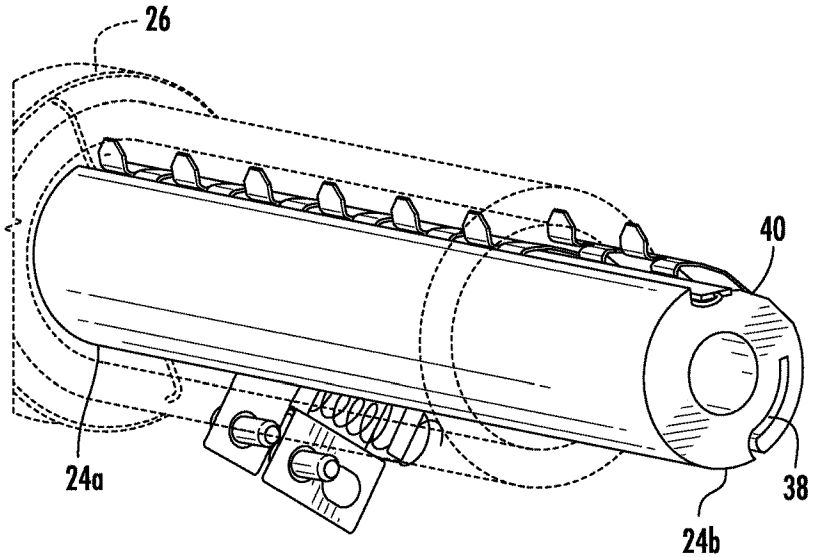
FIG. 5A graphically depicts the compressed and uncompressed electrically conductive springs of the printer spindle assembly of FIG. 2, according to various embodiments of the present invention.
Figure 8B:
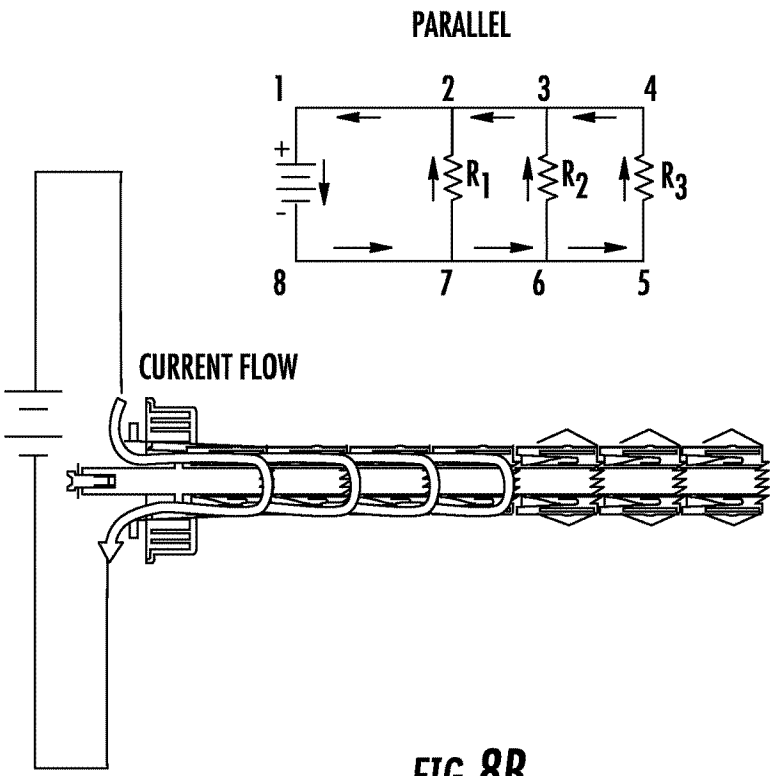
FIG. 8A depicts a series circuit used in the methods according to various embodiments as compared with the conventionally used parallel circuit depicted in FIG. 8B.
Figure 8A:
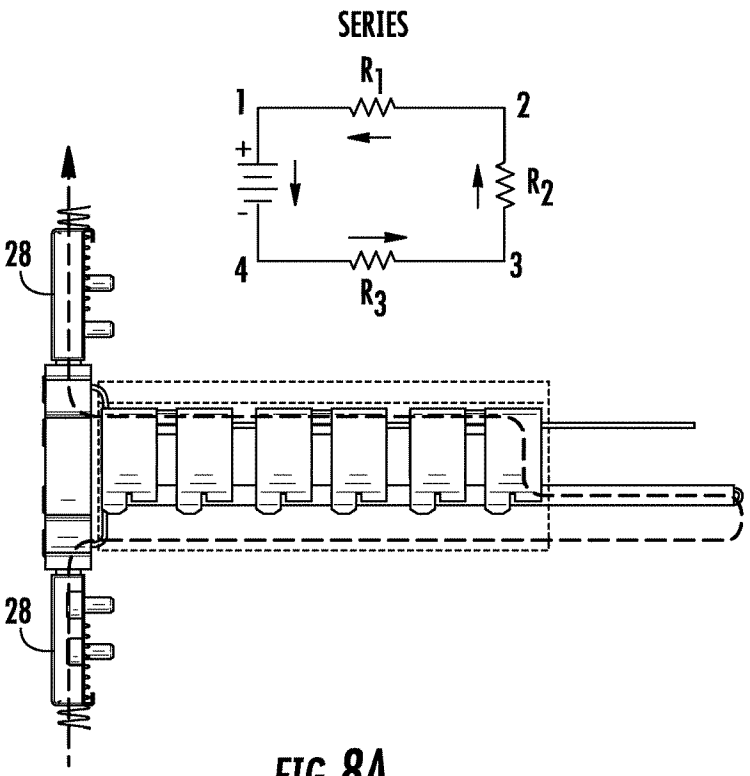

The media width is determined from the difference in electrical resistance caused by compression of the electrically conductive springs contacting the continuous electrically conductive path 40 (see, e.g., FIG. 4A versus FIG. 4B). Thus, as depicted in FIGS. 4A and 4B, the overall resistance of the series circuit will change depending on how many electrical circuits are connected in series to the closed electrical circuit. When a resistance meter is placed in the electrical circuit, the change in resistance can be measured when a media roll is loaded on the media spindle indicating how many electrically conductive springs have been compressed and thus how many electrical circuits are added to the circuit. For example, the width of the media/media roll in FIG. 4A is greater than the width of the media/media roll in FIG. 4B. Therefore, the overall resistance (R2) in FIG. 4B is greater than the resistance (R1) in FIG. 4A. FIG. 8A depicts a series circuit used in the methods according to various embodiments as compared with the conventionally used parallel circuit depicted in FIG. 8B.

Returning again to FIG. 1, according to various embodiments of the present invention, and as noted previously, the printer comprises the processor 33. The processor is configured to determine the width of the media/media roll loaded on the media spindle based upon the measured resistance as determined from the resistance circuitry (the meter). Once the media width is known to the processor, the processor causes an adjustment in media tension in accordance with the media width. The processor may be configured to send information on the width of the media/media roll loaded on the media spindle to the display on the printer.

Figure 9:
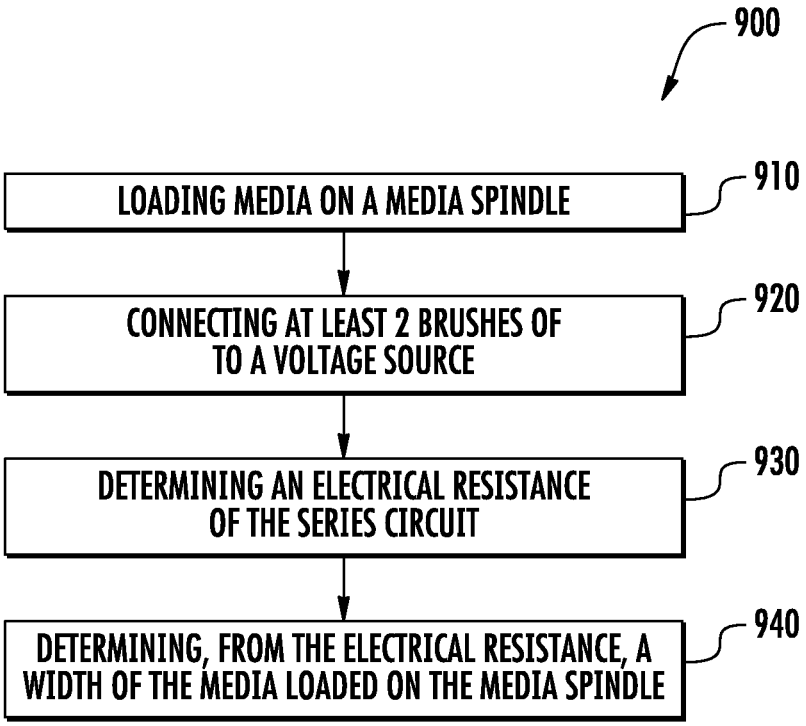
FIG. 9 is a flow diagram of a method for determining media width for controlling media tension, according to various embodiments of the present invention.

Referring now to FIG. 9, according to various embodiments of the present invention, a method 900 for controlling media tension is provided. The method 900 for controlling media tension generally comprises loading media (more particularly, the media roll) on the media spindle of the printer spindle assembly (step 910), connecting the at least two brushes to the voltage source (step 920), determining the electrical resistance of the series circuit (step 930), and determining, from the electrical resistance, a width of the media/media roll loaded on the media spindle (step 940).

Determining the electrical resistance of the series circuit comprises measuring the electrical resistance. The electrical resistance may be measured, for example, with an ohmmeter. Other ways of determining the electrical resistance of the series circuit are contemplated according to various embodiments of the present invention.

Determining the width of the media from the electrical resistance comprises identifying the width of the media that is associated with the electrical resistance. Each different electrical resistance value may be associated with a different width of the media, such as in a look-up table.

From the foregoing, it is to be appreciate that various embodiments automatically determine media width for controlling media tension. Various embodiments provide an automatic system that can sense the width of media/media roll disposed on a printer spindle assembly and feedback this information to an onboard processor that can implement torque requirements to achieve correct media tension, thereby avoiding printing problems associated with using an incorrect media tension.

To supplement the present disclosure, this application incorporates entirely by reference the following commonly assigned patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,525; U.S. Pat. No. 8,794,526; U.S. Pat. No. 8,798,367; U.S. Pat. No. 8,807,431; U.S. Pat. No. 8,807,432; U.S. Pat. No. 8,820,630; U.S. Pat. No. 8,822,848; U.S. Pat. No. 8,824,692; U.S. Pat. No. 8,824,696; U.S. Pat. No. 8,842,849; U.S. Pat. No. 8,844,822; U.S. Pat. No. 8,844,823; U.S. Pat. No. 8,849,019; U.S. Pat. No. 8,851,383; U.S. Pat. No. 8,854,633; U.S. Pat. No. 8,866,963; U.S. Pat. No. 8,868,421; U.S. Pat. No. 8,868,519; U.S. Pat. No. 8,868,802; U.S. Pat. No. 8,868,803; U.S. Pat. No. 8,870,074; U.S. Pat. No. 8,879,639; U.S. Pat. No. 8,880,426; U.S. Pat. No. 8,881,983; U.S. Pat. No. 8,881,987; U.S. Pat. No. 8,903,172; U.S. Pat. No. 8,908,995; U.S. Pat. No. 8,910,870; U.S. Pat. No. 8,910,875; U.S. Pat. No. 8,914,290; U.S. Pat. No. 8,914,788; U.S. Pat. No. 8,915,439; U.S. Pat. No. 8,915,444; U.S. Pat. No. 8,916,789; U.S. Pat. No. 8,918,250; U.S. Pat. No. 8,918,564; U.S. Pat. No. 8,925,818; U.S. Pat. No. 8,939,374; U.S. Pat. No. 8,942,480; U.S. Pat. No. 8,944,313; U.S. Pat. No. 8,944,327; U.S. Pat. No. 8,944,332; U.S. Pat. No. 8,950,678; U.S. Pat. No. 8,967,468; U.S. Pat. No. 8,971,346; U.S. Pat. No. 8,976,030; U.S. Pat. No. 8,976,368; U.S. Pat. No. 8,978,981; U.S. Pat. No. 8,978,983; U.S. Pat. No. 8,978,984; U.S. Pat. No. 8,985,456; U.S. Pat. No. 8,985,457; U.S. Pat. No. 8,985,459; U.S. Pat. No. 8,985,461; U.S. Pat. No. 8,988,578; U.S. Pat. No. 8,988,590; U.S. Pat. No. 8,991,704; U.S. Pat. No. 8,996,194; U.S. Pat. No. 8,996,384; U.S. Pat. No. 9,002,641; U.S. Pat. No. 9,007,368; U.S. Pat. No. 9,010,641;

U.S. Pat. No. 9,015,513; U.S. Pat. No. 9,016,576; U.S. Pat. No. 9,022,288; U.S. Pat. No. 9,030,964; U.S. Pat. No. 9,033,240; U.S. Pat. No. 9,033,242; U.S. Pat. No. 9,036,054; U.S. Pat. No. 9,037,344; U.S. Pat. No. 9,038,911; U.S. Pat. No. 9,038,915; U.S. Pat. No. 9,047,098; U.S. Pat. No. 9,047,359; U.S. Pat. No. 9,047,420; U.S. Pat. No. 9,047,525; U.S. Pat. No. 9,047,531; U.S. Pat. No. 9,053,055; U.S. Pat. No. 9,053,378; U.S. Pat. No. 9,053,380; U.S. Pat. No. 9,058,526; U.S. Pat. No. 9,064,165; U.S. Pat. No. 9,064,165; U.S. Pat. No. 9,064,167; U.S. Pat. No. 9,064,168; U.S. Pat. No. 9,064,254; U.S. Pat. No. 9,066,032; U.S. Pat. No. 9,070,032; U.S. Pat. No. 9,076,459; U.S. Pat. No. 9,079,423; U.S. Pat. No. 9,080,856; U.S. Pat. No. 9,082,023; U.S. Pat. No. 9,082,031; U.S. Pat. No. 9,084,032; U.S. Pat. No. 9,087,250; U.S. Pat. No. 9,092,681; U.S. Pat. No. 9,092,682; U.S. Pat. No. 9,092,683; U.S. Pat. No. 9,093,141; U.S. Pat. No. 9,098,763; U.S. Pat. No. 9,104,929; U.S. Pat. No. 9,104,934; U.S. Pat. No. 9,107,484; U.S. Pat. No. 9,111,159; U.S. Pat. No. 9,111,166; U.S. Pat. No. 9,135,483; U.S. Pat. No. 9,137,009; U.S. Pat. No. 9,141,839; U.S. Pat. No. 9,147,096; U.S. Pat. No. 9,148,474; U.S. Pat. No. 9,158,000; U.S. Pat. No. 9,158,340; U.S. Pat. No. 9,158,953; U.S. Pat. No. 9,159,059; U.S. Pat. No. 9,165,174; U.S. Pat. No. 9,171,543; U.S. Pat. No. 9,183,425; U.S. Pat. No. 9,189,669; U.S. Pat. No. 9,195,844; U.S. Pat. No. 9,202,458; U.S. Pat. No. 9,208,366; U.S. Pat. No. 9,208,367; U.S. Pat. No. 9,219,836; U.S. Pat. No. 9,224,024; U.S. Pat. No. 9,224,027; U.S. Pat. No. 9,230,140; U.S. Pat. No. 9,235,553; U.S. Pat. No. 9,239,950; U.S. Pat. No. 9,245,492; U.S. Pat. No. 9,248,640; U.S. Pat. No. 9,250,652; U.S. Pat. No. 9,250,712; U.S. Pat. No. 9,251,411; U.S. Pat. No. 9,258,033; U.S. Pat. No. 9,262,633; U.S. Pat. No. 9,262,660; U.S. Pat. No. 9,262,662; U.S. Pat. No. 9,269,036; U.S. Pat. No. 9,270,782; U.S. Pat. No. 9,274,812; U.S. Pat. No. 9,275,388; U.S. Pat. No. 9,277,668; U.S. Pat. No. 9,280,693; U.S. Pat. No. 9,286,496; U.S. Pat. No. 9,298,964; U.S. Pat. No. 9,301,427; U.S. Pat. No. 9,313,377; U.S. Pat. No. 9,317,037; U.S. Pat. No. 9,319,548; U.S. Pat. No. 9,342,723; U.S. Pat. No. 9,361,882; U.S. Pat. No. 9,365,381; U.S. Pat. No. 9,373,018; U.S. Pat. No. 9,375,945; U.S. Pat. No. 9,378,403; U.S. Pat. No. 9,383,848; U.S. Pat. No. 9,384,374; U.S. Pat. No. 9,390,304; U.S. Pat. No. 9,390,596; U.S. Pat. No. 9,411,386; U.S. Pat. No. 9,412,242; U.S. Pat. No. 9,418,269; U.S. Pat. No. 9,418,270; U.S. Pat. No. 9,465,967; U.S. Pat. No. 9,423,318; U.S. Pat. No. 9,424,454; U.S. Pat. No. 9,436,860; U.S. Pat. No. 9,443,123; U.S. Pat. No. 9,443,222; U.S. Pat. No. 9,454,689; U.S. Pat. No. 9,464,885; U.S. Pat. No. 9,465,967; U.S. Pat. No. 9,478,983; U.S. Pat. No. 9,481,186; U.S. Pat. No. 9,487,113; U.S. Pat. No. 9,488,986; U.S. Pat. No. 9,489,782; U.S. Pat. No. 9,490,540; U.S. Pat. No. 9,491,729; U.S. Pat. No. 9,497,092; U.S. Pat. No. 9,507,974; U.S. Pat. No. 9,519,814; U.S. Pat. No. 9,521,331; U.S. Pat. No. 9,530,038; U.S. Pat. No. 9,572,901; U.S. Pat. No. 9,558,386; U.S. Pat. No. 9,606,581; U.S. Pat. No. 9,646,189; U.S. Pat. No. 9,646,191; U.S. Pat. No. 9,652,648; U.S. Pat. No. 9,652,653; U.S. Pat. No. 9,656,487; U.S. Pat. No. 9,659,198; U.S. Pat. No. 9,680,282; U.S. Pat. No. 9,697,401; U.S. Pat. No. 9,701,140;

U.S. Design Pat. No. D702,237;
U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D734,339;
U.S. Design Pat. No. D737,321;
U.S. Design Pat. No. D754,205;
U.S. Design Pat. No. D754,206;
U.S. Design Pat. No. D757,009;
U.S. Design Pat. No. D760,719;
U.S. Design Pat. No. D762,604;
U.S. Design Pat. No. D766,244;
U.S. Design Pat. No. D777,166;
U.S. Design Pat. No. D771,631;
U.S. Design Pat. No. D783,601;
U.S. Design Pat. No. D785,617;
U.S. Design Pat. No. D785,636;
U.S. Design Pat. No. D790,505;
U.S. Design Pat. No. D790,546;
International Publication No. 2013/163789;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0194692;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0332996;
U.S. Patent Application Publication No. 2014/0001267;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;

U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131443;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0191684;
U.S. Patent Application Publication No. 2014/0191913;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0231500;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0332590;
U.S. Patent Application Publication No. 2014/0351317;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0009338;
U.S. Patent Application Publication No. 2015/0014416;
U.S. Patent Application Publication No. 2015/0021397;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0049347;
U.S. Patent Application Publication No. 2015/0051992;
U.S. Patent Application Publication No. 2015/0053769;
U.S. Patent Application Publication No. 2015/0062366;
U.S. Patent Application Publication No. 2015/0063215;
U.S. Patent Application Publication No. 2015/0088522;
U.S. Patent Application Publication No. 2015/0096872;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0149946;
U.S. Patent Application Publication No. 2015/0161429;
U.S. Patent Application Publication No. 2015/0178523;
U.S. Patent Application Publication No. 2015/0178537;
U.S. Patent Application Publication No. 2015/0178685;
U.S. Patent Application Publication No. 2015/0181109;
U.S. Patent Application Publication No. 2015/0199957;
U.S. Patent Application Publication No. 2015/0210199;
U.S. Patent Application Publication No. 2015/0212565;
U.S. Patent Application Publication No. 2015/0213647;
U.S. Patent Application Publication No. 2015/0220753;
U.S. Patent Application Publication No. 2015/0220901;
U.S. Patent Application Publication No. 2015/0227189;
U.S. Patent Application Publication No. 2015/0236984;
U.S. Patent Application Publication No. 2015/0239348;
U.S. Patent Application Publication No. 2015/0242658;
U.S. Patent Application Publication No. 2015/0248572;
U.S. Patent Application Publication No. 2015/0254485;
U.S. Patent Application Publication No. 2015/0261643;
U.S. Patent Application Publication No. 2015/0264624;
U.S. Patent Application Publication No. 2015/0268971;
U.S. Patent Application Publication No. 2015/0269402;
U.S. Patent Application Publication No. 2015/0288689;
U.S. Patent Application Publication No. 2015/0288896;
U.S. Patent Application Publication No. 2015/0310243;
U.S. Patent Application Publication No. 2015/0310244;
U.S. Patent Application Publication No. 2015/0310389;
U.S. Patent Application Publication No. 2015/0312780;
U.S. Patent Application Publication No. 2015/0327012;
U.S. Patent Application Publication No. 2016/0014251;
U.S. Patent Application Publication No. 2016/0025697;
U.S. Patent Application Publication No. 2016/0026838;
U.S. Patent Application Publication No. 2016/0026839;
U.S. Patent Application Publication No. 2016/0040982;
U.S. Patent Application Publication No. 2016/0042241;
U.S. Patent Application Publication No. 2016/0057230;
U.S. Patent Application Publication No. 2016/0062473;
U.S. Patent Application Publication No. 2016/0070944;
U.S. Patent Application Publication No. 2016/0092805;
U.S. Patent Application Publication No. 2016/0101936;
U.S. Patent Application Publication No. 2016/0104019;
U.S. Patent Application Publication No. 2016/0104274;
U.S. Patent Application Publication No. 2016/0109219;
U.S. Patent Application Publication No. 2016/0109220;
U.S. Patent Application Publication No. 2016/0109224;
U.S. Patent Application Publication No. 2016/0112631;
U.S. Patent Application Publication No. 2016/0112643;
U.S. Patent Application Publication No. 2016/0117627;
U.S. Patent Application Publication No. 2016/0124516;
U.S. Patent Application Publication No. 2016/0125217;
U.S. Patent Application Publication No. 2016/0125342;
U.S. Patent Application Publication No. 2016/0125873;
U.S. Patent Application Publication No. 2016/0133253;
U.S. Patent Application Publication No. 2016/0171597;
U.S. Patent Application Publication No. 2016/0171666;

U.S. Patent Application Publication No. 2016/0171720;
U.S. Patent Application Publication No. 2016/0171775;
U.S. Patent Application Publication No. 2016/0171777;
U.S. Patent Application Publication No. 2016/0174674;
U.S. Patent Application Publication No. 2016/0178479;
U.S. Patent Application Publication No. 2016/0178685;
U.S. Patent Application Publication No. 2016/0178707;
U.S. Patent Application Publication No. 2016/0179132;
U.S. Patent Application Publication No. 2016/0179143;
U.S. Patent Application Publication No. 2016/0179368;
U.S. Patent Application Publication No. 2016/0179378;
U.S. Patent Application Publication No. 2016/0180130;
U.S. Patent Application Publication No. 2016/0180133;
U.S. Patent Application Publication No. 2016/0180136;
U.S. Patent Application Publication No. 2016/0180594;
U.S. Patent Application Publication No. 2016/0180663;
U.S. Patent Application Publication No. 2016/0180678;
U.S. Patent Application Publication No. 2016/0180713;
U.S. Patent Application Publication No. 2016/0185136;
U.S. Patent Application Publication No. 2016/0185291;
U.S. Patent Application Publication No. 2016/0186926;
U.S. Patent Application Publication No. 2016/0188861;
U.S. Patent Application Publication No. 2016/0188939;
U.S. Patent Application Publication No. 2016/0188940;
U.S. Patent Application Publication No. 2016/0188941;
U.S. Patent Application Publication No. 2016/0188942;
U.S. Patent Application Publication No. 2016/0188943;
U.S. Patent Application Publication No. 2016/0188944;
U.S. Patent Application Publication No. 2016/0189076;
U.S. Patent Application Publication No. 2016/0189087;
U.S. Patent Application Publication No. 2016/0189088;
U.S. Patent Application Publication No. 2016/0189092;
U.S. Patent Application Publication No. 2016/0189284;
U.S. Patent Application Publication No. 2016/0189288;
U.S. Patent Application Publication No. 2016/0189366;
U.S. Patent Application Publication No. 2016/0189443;
U.S. Patent Application Publication No. 2016/0189447;
U.S. Patent Application Publication No. 2016/0189489;
U.S. Patent Application Publication No. 2016/0192051;
U.S. Patent Application Publication No. 2016/0202951;
U.S. Patent Application Publication No. 2016/0202958;
U.S. Patent Application Publication No. 2016/0202959;
U.S. Patent Application Publication No. 2016/0203021;
U.S. Patent Application Publication No. 2016/0203429;
U.S. Patent Application Publication No. 2016/0203797;
U.S. Patent Application Publication No. 2016/0203820;
U.S. Patent Application Publication No. 2016/0204623;
U.S. Patent Application Publication No. 2016/0204636;
U.S. Patent Application Publication No. 2016/0204638;
U.S. Patent Application Publication No. 2016/0227912;
U.S. Patent Application Publication No. 2016/0232891;
U.S. Patent Application Publication No. 2016/0292477;
U.S. Patent Application Publication No. 2016/0294779;
U.S. Patent Application Publication No. 2016/0306769;
U.S. Patent Application Publication No. 2016/0314276;
U.S. Patent Application Publication No. 2016/0314294;
U.S. Patent Application Publication No. 2016/0316190;
U.S. Patent Application Publication No. 2016/0323310;
U.S. Patent Application Publication No. 2016/0325677;
U.S. Patent Application Publication No. 2016/0327614;
U.S. Patent Application Publication No. 2016/0327930;
U.S. Patent Application Publication No. 2016/0328762;
U.S. Patent Application Publication No. 2016/0330218;
U.S. Patent Application Publication No. 2016/0343163;
U.S. Patent Application Publication No. 2016/0343176;
U.S. Patent Application Publication No. 2016/0364914;
U.S. Patent Application Publication No. 2016/0370220;
U.S. Patent Application Publication No. 2016/0372282;
U.S. Patent Application Publication No. 2016/0373847;
U.S. Patent Application Publication No. 2016/0377414;
U.S. Patent Application Publication No. 2016/0377417;
U.S. Patent Application Publication No. 2017/0010141;
U.S. Patent Application Publication No. 2017/0010328;
U.S. Patent Application Publication No. 2017/0010780;
U.S. Patent Application Publication No. 2017/0016714;
U.S. Patent Application Publication No. 2017/0018094;
U.S. Patent Application Publication No. 2017/0046603;
U.S. Patent Application Publication No. 2017/0047864;
U.S. Patent Application Publication No. 2017/0053146;
U.S. Patent Application Publication No. 2017/0053147;
U.S. Patent Application Publication No. 2017/0053647;
U.S. Patent Application Publication No. 2017/0055606;
U.S. Patent Application Publication No. 2017/0060316;
U.S. Patent Application Publication No. 2017/0061961;
U.S. Patent Application Publication No. 2017/0064634;
U.S. Patent Application Publication No. 2017/0083730;
U.S. Patent Application Publication No. 2017/0091502;
U.S. Patent Application Publication No. 2017/0091706;
U.S. Patent Application Publication No. 2017/0091741;
U.S. Patent Application Publication No. 2017/0091904;
U.S. Patent Application Publication No. 2017/0092908;
U.S. Patent Application Publication No. 2017/0094238;
U.S. Patent Application Publication No. 2017/0098947;
U.S. Patent Application Publication No. 2017/0100949;
U.S. Patent Application Publication No. 2017/0108838;
U.S. Patent Application Publication No. 2017/0108895;
U.S. Patent Application Publication No. 2017/0118355;
U.S. Patent Application Publication No. 2017/0123598;
U.S. Patent Application Publication No. 2017/0124369;
U.S. Patent Application Publication No. 2017/0124396;
U.S. Patent Application Publication No. 2017/0124687;
U.S. Patent Application Publication No. 2017/0126873;
U.S. Patent Application Publication No. 2017/0126904;
U.S. Patent Application Publication No. 2017/0139012;
U.S. Patent Application Publication No. 2017/0140329;
U.S. Patent Application Publication No. 2017/0140731;
U.S. Patent Application Publication No. 2017/0147847;
U.S. Patent Application Publication No. 2017/0150124;
U.S. Patent Application Publication No. 2017/0169198;
U.S. Patent Application Publication No. 2017/0171035;
U.S. Patent Application Publication No. 2017/0171703;
U.S. Patent Application Publication No. 2017/0171803;
U.S. Patent Application Publication No. 2017/0180359;
U.S. Patent Application Publication No. 2017/0180577;
U.S. Patent Application Publication No. 2017/0181299;
U.S. Patent Application Publication No. 2017/0190192;
U.S. Patent Application Publication No. 2017/0193432;
U.S. Patent Application Publication No. 2017/0193461;
U.S. Patent Application Publication No. 2017/0193727;
U.S. Patent Application Publication No. 2017/0199266;
U.S. Patent Application Publication No. 2017/0200108; and
U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A printer spindle assembly comprising:

a media spindle having a first end and a second end;

a commutator disposed circumferentially at the first end of the media spindle;

at least two brushes in electrical contact with the commutator and connected to a voltage source, the voltage source, the at least two brushes, and the commutator forming a closed electrical circuit;

a plurality of electrically conductive springs serially disposed on the media spindle in electrical communication with the commutator, wherein each electrically conductive spring is configured to be in an uncompressed state in the absence of media on the media spindle and one or more of the electrically conductive springs is configured to be in a compressed state in the presence of the media on the media spindle; and a continuous electrically conductive path formed of electrically resistive material disposed along a longitudinal axis of the media spindle and configured to be in electrical contact with a first spring end of the one or more electrically conductive springs in the compressed state to form a series circuit.

2. The printer spindle assembly according to claim 1, wherein each conductive spring in electrical contact with the continuous electrically conductive path decreases an amount of the electrically resistive material in the series circuit.

3. The printer spindle assembly according to claim 2, wherein the amount of the electrically resistive material in the series circuit and therefore resistance in the series circuit increases with a decrease in a width of the media.

4. The printer spindle assembly according to claim 1, wherein the media spindle includes a groove for receiving a second spring end of each electrically conductive spring.

5. The printer spindle assembly according to claim 1, wherein the media spindle comprises a nonconductive material and each electrically conductive spring is metallic.

6. The printer spindle assembly according to claim 1, wherein the plurality of electrically conductive springs, each electrically conductive spring comprising a pair of conjoined spring portions having a space therebetween to impart compressibility to each electrically conductive spring.

7. The printer spindle assembly according to claim 3, wherein the printer further comprises a processor configured to determine a width of the media loaded on the media spindle based on the resistance of the series circuit and configured to adjust torsion on the media based upon the determined width of the media.

8. The printer spindle assembly according to claim 7, wherein the processor is further configured to send information on the width of the media loaded on the media spindle to a printer display.

9. The printer spindle assembly according to claim 1, wherein the printer further comprises a processor and the closed electrical circuit connects the series circuit to a main electrical control unit housing the processor.

10. The printer spindle assembly according to claim 1, wherein the media spindle, the plurality of electrically conductive springs, and the electrically resistive material collectively comprise a rotational potentiometer.

11. A printer comprising:

a spindle assembly comprising:

a media spindle having a first end and a second end;

a commutator disposed circumferentially at the first end of the media spindle;

at least two brushes in electrical contact with the commutator and connected to a voltage source, the voltage source, the at least two brushes, and the commutator forming a closed electrical circuit;

a plurality of electrically conductive springs serially disposed on the media spindle in electrical communication with the commutator, wherein each electrically conductive spring is configured to be in an uncompressed state in the absence of media on the media spindle and one or more of the conductive springs is configured to be in a compressed state in the presence of the media on the media spindle; and a continuous electrically conductive path formed of electrically resistive material disposed along a longitudinal axis of the media spindle and configured to be in electrical contact with a first spring end of the one or more electrically conductive springs in the compressed state to form a series circuit; and a processor configured to determine a width of the media loaded on the media spindle based on the resistance of the series circuit and configured to adjust torsion on the media based upon the determined width of the media.

12. The printer according to claim 11, wherein each conductive spring in electrical contact with the continuous electrically conductive path decreases an amount of the electrically resistive material in the series circuit.

13. The printer according to claim 12, wherein the amount of the electrically resistive material in the series circuit and therefore resistance in the series circuit increases with a decrease in a width of the media.

14. The printer according to claim 11, wherein the media spindle includes a groove for receiving a second spring end of each electrically conductive spring.

15. The printer according to claim 11, wherein the media spindle comprises a nonconductive material and each electrically conductive spring is metallic.

16. The printer according to claim 11, wherein the plurality of electrically conductive springs, each electrically conductive spring comprising a pair of conjoined spring portions having a space therebetween to impart compressibility to each electrically conductive spring.

17. The printer according to claim 11, wherein the media spindle, the plurality of electrically conductive springs, and the electrically resistive material collectively comprise a rotational potentiometer.

18. A method comprising:

loading media on a media spindle of a printer spindle assembly, the media spindle having a first end and a second end and the printer spindle assembly comprising:

a commutator disposed circumferentially at the first end of the media spindle;

at least two brushes in electrical contact with the commutator and connected to a voltage source, the voltage source, the at least two brushes, and the commutator forming a closed electrical circuit;

a plurality of electrically conductive springs serially disposed on the media spindle in electrical communication with the commutator, wherein each electrically conductive spring is configured to be in an uncompressed state in the absence of the media on the media spindle and one or more of the electrically conductive springs is configured to be in a compressed state in the presence of the media on the media spindle; and a continuous electrically conductive path formed of electrically resistive material disposed along a longitudinal axis of the media spindle and configured to be in electrical contact with a first spring end of the one or more electrically conductive springs in the compressed state to form a series circuit;

connecting the at least two brushes to a voltage source;

determining an electrical resistance of the series circuit; and determining, from the electrical resistance, a width of the media loaded on the media spindle.

19. The method according to claim 18, wherein determining the width from the electrical resistance comprises identifying the width of the media that is associated with the electrical resistance.

20. The method according to claim 19, wherein each different electrical resistance value is associated with a different width of the media.

* * * * *